US009296547B2

(12) United States Patent
Larsen

(10) Patent No.: US 9,296,547 B2
(45) Date of Patent: Mar. 29, 2016

(54) ASSEMBLY ASSEMBLED OF A RECIPIENT AND A RETAINER, A METHOD FOR PRODUCING THE ASSEMBLY, AND A USE OF THE ASSEMBLY

(71) Applicant: ALL IN ONE BAG ApS, Holte (DK)

(72) Inventor: Bjorn Karlo Larsen, Stenlose (DK)

(73) Assignee: ALL IN ONE BAG ApS, Holte (DK)

( * ) Notice: Subject to any disclaimer, the term of this patent is extended or adjusted under 35 U.S.C. 154(b) by 0 days.

(21) Appl. No.: 14/381,141

(22) PCT Filed: Feb. 26, 2013

(86) PCT No.: PCT/DK2013/050050
§ 371 (c)(1),
(2) Date: Aug. 26, 2014

(87) PCT Pub. No.: WO2013/127399
PCT Pub. Date: Sep. 6, 2013

(65) Prior Publication Data

US 2015/0028049 A1 Jan. 29, 2015

(30) Foreign Application Priority Data

Feb. 27, 2012 (DK) ..... 2012 00158

(51) Int. Cl.
*B65D 1/34* (2006.01)
*B65D 83/08* (2006.01)
(Continued)

(52) U.S. Cl.
CPC ..... *B65D 83/0805* (2013.01); *B31B 19/26* (2013.01); *B31B 41/00* (2013.01); *B65F 1/0006* (2013.01); *B31B 2221/10* (2013.01)

(58) Field of Classification Search
CPC .... B65D 83/0805; B65F 1/0006; B31B 19/26
USPC ..... 206/37–39, 440, 461, 466, 471, 494, 206/496, 554; 53/469; 220/908.1; 221/45, 221/63; 493/210
See application file for complete search history.

(56) References Cited

U.S. PATENT DOCUMENTS 4,117,847 A 10/1978 Clayton
4,216,863 A * 8/1980 Seymour-Smith ..... 206/554
(Continued)

FOREIGN PATENT DOCUMENTS

DE 2624437 A1 12/1977
DK 201100041 U3 6/2012
(Continued)

OTHER PUBLICATIONS

International Search Report, PCT/DK2013/050050, mailed Jun. 7, 2013.

*Primary Examiner* — Luan K Bui
(74) *Attorney, Agent, or Firm* — Winston & Strawn LLP

(57) ABSTRACT

An assembly of a recipient for in a using state of the assembly receiving objects of different kinds and of a retainer for in a resting state of the assembly retaining the recipient. The retainer is formed as a case and the recipient is, before being assembled with the case, formed as a tube which has a first and second end part and in the resting state of the assembly has been folded up in a predetermined way into at least nearly parallel folds and, which are placed close to and/or are abutting each other. The assembly forms, when being in use, a desirable large bag for containing objects of different kinds and when not being in use a small case which is comfortable to store and handle.

19 Claims, 5 Drawing Sheets

(51) Int. Cl.

| | |
|---|---|
| ***B65F 1/00*** | (2006.01) |
| ***B31B 19/26*** | (2006.01) |
| ***B31B 41/00*** | (2006.01) |

(56) References Cited

U.S. PATENT DOCUMENTS

| | | | | | |
|---|---|---|---|---|---|
| 4,487,318 | A | * | 12/1984 | Roen | 206/554 |
| 5,083,661 | A | * | 1/1992 | Burwell | 206/37 |
| 5,182,895 | A | * | 2/1993 | Lugo | 53/469 |
| 5,560,321 | A | * | 10/1996 | Hess | 119/858 |
| 5,857,586 | A | * | 1/1999 | Scherr | 221/45 |
| 6,116,418 | A | * | 9/2000 | Sadow | 206/460 |
| 6,286,680 | B1 | | 9/2001 | Hofrichter | |
| 6,571,984 | B1 | | 6/2003 | Winesett | |
| 2003/0052034 | A1 | * | 3/2003 | Bredahl | 206/494 |
| 2003/0116296 | A1 | * | 6/2003 | Lin et al. | 493/37 |
| 2003/0154931 | A1 | * | 8/2003 | Ostrowiecki | 206/554 |
| 2005/0252819 | A1 | * | 11/2005 | Chum | 206/554 |
| 2006/0261079 | A1 | * | 11/2006 | Sadi | 221/63 |
| 2010/0234819 | A1 | | 9/2010 | McGarity et al. | |

FOREIGN PATENT DOCUMENTS

| | | | |
|---|---|---|---|
| EP | 2062494 | A2 | 5/2009 |
| FR | 2798117 | A1 | 3/2001 |
| WO | WO2008023363 | A2 | 2/2008 |

* cited by examiner

ASSEMBLY ASSEMBLED OF A RECIPIENT AND A RETAINER, A METHOD FOR PRODUCING THE ASSEMBLY, AND A USE OF THE ASSEMBLY

This application is a 371 filing of International Patent Application PCT/DK2013/050050 filed Feb. 26, 2013, which claims priority to Danish application no. PA201200158 filed Feb. 27, 2012.

BACKGROUND

The invention relates to an assembly of a recipient for in a using state of the assembly receiving objects of different kinds and of a retainer for in a resting state of the assembly retaining the recipient.

The invention also relates to a method for producing the assembly and to a use of the assembly and of the method for producing the assembly.

Frequently are objects turning up of such kind, that it is necessary rapidly to put them into a safe packaging for thereby securely avoiding polluting of the surroundings and to keep them too in said packing until they can be disposed.

Such objects can among other things be for instance garbage of different kinds, napkins, sanitary towels and incontinence means.

Especially inexpensive bags are widely used for in an easy and comfortable way keeping objects of e.g. the above-mentioned kind safely isolated from the surroundings and to be disposed together with the bags.

Each bag need to have a sufficiently large size for being able to contain suitable portions of objects whereby storing of new bags can be a problem in itself.

Usually the bags therefore are marketed in form of rolls of long strips which each comprises a number of flat-laid bags separated from each other by transverse perforating lines.

In situations where a user requires a bag for being able to packing objects, the user needs to take a roll of bags out of a depository, unroll the roll at least partly, tearing off a bag from the rest of the bags in the roll along a perforating line, rolling up the roll again and replacing the roll in the depository.

It is self-evident that it is a slow process to get hold in a bag in such way and that it moreover is a tiresome and time-wasting work, which often need to be repeated more times a day.

And said operations is furthermore nearly impossible to perform when the user is out of the house, e.g. driving a car, so that he/her doesn't dispose of a store of bags.

An attempt to solve those problems is known from the U.S. Pat. No. 4,117,847 disclosing a shopping bag with a case attached to the inner side of the bag at the edge of its mouth.

The purpose of this arrangement is to reduce the volume of the shopping bag when not being used so that it will be more comfortable for the user to handle and store the bag. The reducing of the volume takes however place by in an accidentally way folding and rolling up the bag and putting the bag packed together in this way into the case which therefore need to have a relatively large volume.

Owing to the fact that the case is placed on the inside and not on the outside of the bag are those operations also difficult and troublesome to carry out.

The arrangement for reducing the volume of the bag reduces unfortunately also the use-value of the shopping bag because the case, which as mentioned is placed on the inner side of the bag, is occupying some of the compartment in the shopping bag and also more or less is in the way for articles being put into the bag via the mouth of this.

The position of the case inside the bag also causes that disadvantages that the bag only partly can be stored in the case and that some of the bag is exposed to external influences there, if occasion should arise, could damage the bag more or less even in its storing state.

This known assembly of a bag and case is adapted for alternatively being used as a shopping bag and to be packed up in the case for temporary being stored whereby said assembling need to have a relatively heavy and therefore expensive structure which is unfit for being used to e.g. an inexpensive disposable bag.

The Danish utility application BA 2011 00041 discloses an assembly of a bag for in a using state of the assembly receiving objects of different kinds and of a case for in a resting state of the assembly storing the bag.

The bag of this known assembly is in the resting state folded up in the case in an accidentally way causing the assembly of the bag and the case to be troublesome and uncertain and the case to get an undesired large size so that it can be able to contain the relatively large volume of the tube being packed up in the case in this way.

SUMMARY OF THE INVENTION

The above-mentioned disadvantages of the prior art assembly of a recipient for in an using state of the assembly receiving objects of different kinds and of a retainer for in a resting state of the assembly retaining the recipient are according to the invention remedied by, in a first aspect of the invention providing an assembly of the kind mentioned in the opening paragraph which in the using state forms a suitable large compartment for containing objects and in the resting state is small enough to make the assembly easy and comfortable to store and handle, in a second aspect of the invention providing an assembly of the kind mentioned in the opening paragraph which has a simple and inexpensive structure.

in a third aspect of the invention providing an assembly of the kind mentioned in the opening paragraph which easy and fast can be transformed from resting to using state, in a fourth aspect of the invention providing an assembly of the kind mentioned in the opening paragraph in which the retainer is protecting the recipient against sustaining damage in the resting state of the assembly, in a fifth aspect of the invention providing a method for assembling the assembly mentioned in the opening paragraph of a recipient adapted for in a using state of the assembly receiving objects of different kinds and of a retainer adapted for in a resting state of the assembly retaining the recipient, in a sixth aspect of the invention providing a use of the assembly and of the method mentioned in the opening paragraph.

The novel and unique features whereby these and further aspects of the invention are achieved consists in the fact that the retainer is formed as a case and that the recipient, before being assembled with the case, is formed as a flexible tube which has a first and second end part and in the resting state of the assembly is folded up in a predetermined way in the case into at least nearly parallel folds, which are placed close to and/or are abutting each other.

The special way upon which the tube of the invention is folded up secures advantageously that the tube can be folded up into a very small size so that the case can be formed with a corresponding small size whereby the assembly in its resting state is easy and comfortable to store and handle and in the using state has a suitable large compartment for receiving the desired volume of objects.

In an expedient embodiment of the invention can the retainer moreover be formed as a case with an access opening into a cavity which has an area defined by a depth extending into a direction perpendicular to the access opening and a width extending into a direction perpendicular to the direction of the depth whereby the tube can have a larger area than said cavity.

The assembly of the tube and the case thus achieves a simple and inexpensive structure, which in the using state advantageously has a large capacity for containing objects and in the resting state has a very little volume.

In another embodiment of the invention can one of the folds of the tube be attached to the case while the other folds freely can be arranged in the case, and the second end part of the tube can simultaneously be formed with the mouth of the tube placed at the access opening of the case whereby is obtained that advantage that the bag safely is secured to the case and is ready also for quickly being pulled out of the case into the using position.

Said pulling operation can moreover be easy and safe to carry out when the second end part of the tube is equipped with one or more flaps protruding out of the case so that a user easily can catch said flaps with the fingers and thereby be able to comfortable and quickly pulling the tube out of the case.

In a variant of this embodiment can the flaps be present inside the case in the resting state of the assembly where the tube is folded up in the case, while a releasable cap covers the access opening of the case. The flaps thereby securely are protected against external influences in the resting state of the assembly.

When the access opening of the case has a length, which is smaller than the width of the case is advantageously achieved that the bag, when being present in the case in the resting state of the assembly, is secured against accidentally falling out of the case.

In a very advantageous embodiment of the invention can the tube in flat-laid state be folded along a first row of first folding lines, which are extending crosswise the end parts of the tube and are defining a first row of parallel first folds of which at least one has a width with about the same size as the width of the cavity of the case, and the first row of first folds can furthermore be folded along a second row of second folding lines, which are extending crosswise the first folding lines and are defining a second row of parallel second folds of which at least one has a width with about the same size as the depth of the cavity of the case.

By means of this particular folding method has the tube achieved the shape of a very compact packet of folds with a volume as little as possible whereby the case can be formed with a corresponding little volume so that the assembly of the invention is very handy to handle and store in the resting state of the assembly.

According to the invention can the tube be made of a foldable material and the case of a material, which is strong enough to protect the tube against being damaged by external influences.

Material for making the tube can according to the invention be plastic or paper and material for making the case can be plastic, paper, cardboard or metal.

The assembly of a recipient for in a using state of the assembly receiving objects of different kinds and of a retainer for in a resting state of the assembly retaining the recipient can in an expedient embodiment of the invention be produced by forming the recipient as a tube of a foldable material, flat-laying the tube, folding up the flat-laid tube in a predetermined way into parallel folds, which are placed close to each other or are abutting each other, and placing the tube in the retainer. In this way can the assembly advantageously be produced in a fast, simple and inexpensive way.

In one embodiment of the method can the tube be formed of a sheet of a flexible and foldable material by folding the sheet and welding or gluing the longitudinally extending edges of the sheet together and in another embodiment of the method can the tube be formed of two sheets of a flexible and foldable material and welding or gluing the longitudinally extending edges of the two sheets together. Both methods are fast and easy to utilize and the tube produced has a simple and inexpensive structure.

In a third embodiment of the invention can the tube be formed by extruding a hose of a foldable plastic with a relatively little wall-thickness and cutting the hose crosswise into pieces of the required lengths. This method is especially well suited for in a fast way producing large quantities of thin-walled tubes.

The assembly of the tube and the case and the method for making the assembly can according to the invention advantageously be used as a bag for containing a relatively large volume of objects even though the assembly can have a relatively little volume when not being used.

BRIEF DESCRIPTION OF THE DRAWINGS

The invention will be explained in greater details below, giving further advantageous features and technical effects and showing also the successive operations steps of an exemplary embodiment with reference to the drawing, in which.

DETAILED DESCRIPTION OF THE INVENTION

The assembly of the invention is, as previously mentioned, assembled of a relative small and handy case for in a resting state storing a relatively large tube which in a using state is protruding out of the case so that the assembly can function as a bag being able to contain relatively large quantities of objects of different kinds, such as e.g. garbage.

Figure 1:
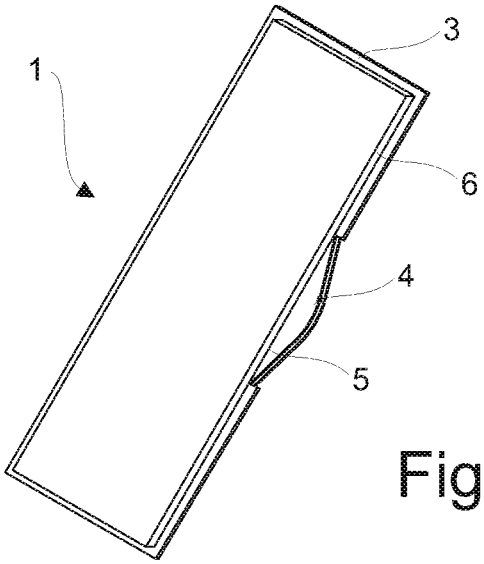
FIG. 1 is a perspective view, seen in the resting state of the assembly, which assembly according to the invention is assembled of a tube for in a using state receiving objects of different kinds and of a case for in a resting state storing the tube.
Figure 2:
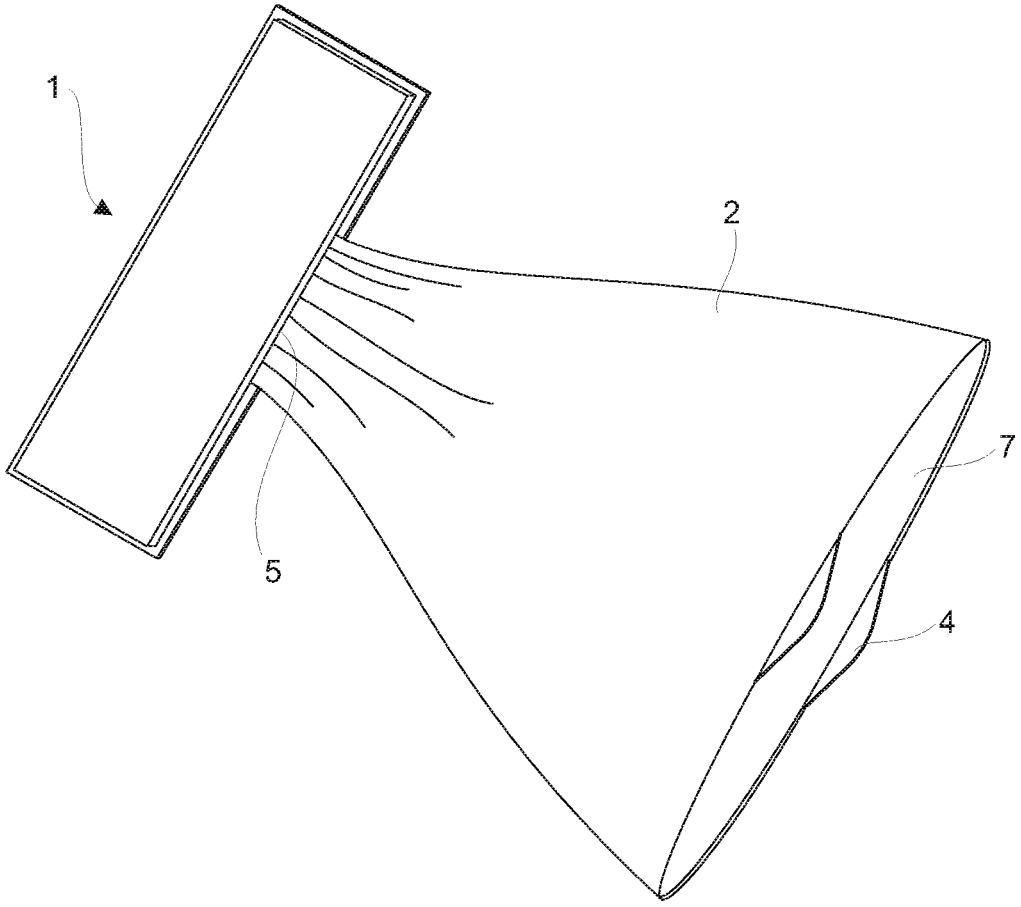
FIG. 2 shows the assembly, seen in the using state.

FIG. 1 shows the assembly 1 in the resting state where the tube 2 is placed inside the case 3, and FIG. 2 shows the assembly in the using state where the tube 2—here only partly—has been pulled out of the case via an access opening 5, formed in a lateral edge 6 of the case, while a user (not seen) is holding two flaps 4, placed at the mouth 7 of the tube, with one hand (not seen) and the case with the other hand (not seen).

The tube can have one flap only or two or more flaps and each flap can be integral with the wall of the tube or be attached to this wall.

The little and handy case, which owing to its small size, can be stored nearly everywhere, for example in kitchens, handbags and coat pockets, can thus nearly instantaneously be transformed to a large and useful bag for, when needed, receiving and containing required quantities of objects of different kinds.

Figure 3:
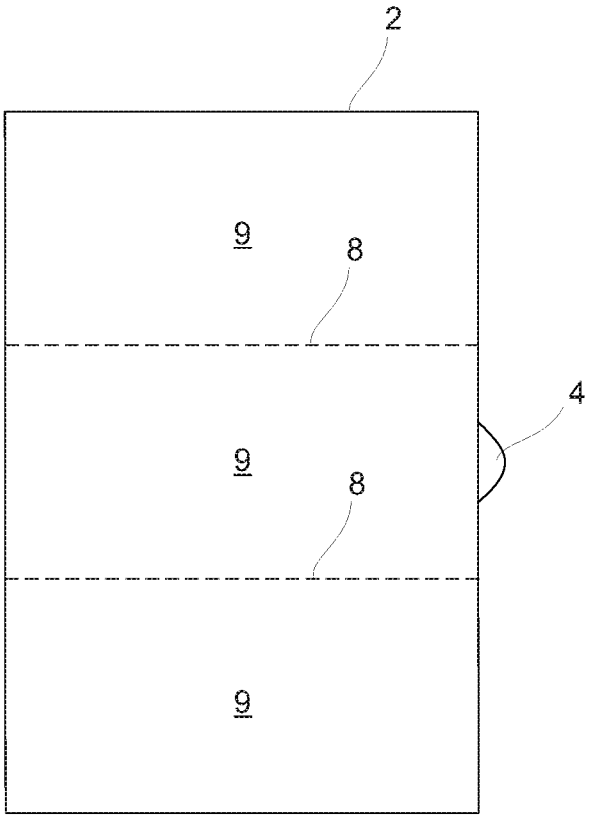
FIG. 3 shows, seen from the side, the tube of the assembly shown in FIGS. 1 and 2.

As mentioned above and seen also in FIGS. 1 and 2 is the tube 2 assembled with the case 1, but in FIG. 3 is the tube shown, seen from the side, before said assembling has been carried out.

Figure 4:
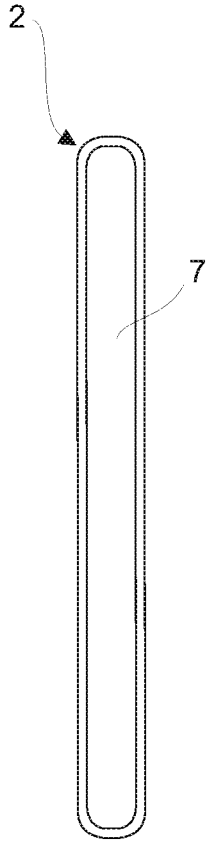
FIG. 4 is a cross-sectional view of the tube shown in FIG. 3.

FIG. 4 shows a cross-sectional view of the tube 2, which is made of a relative thin wall of a foldable material, e.g. plastic or paper.

Figure 5:
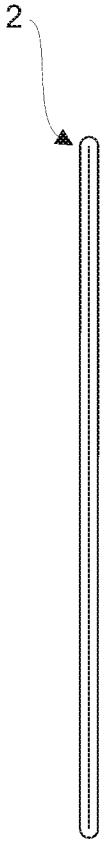
FIG. 5 shows the same in a flat-laid state.

FIG. 5 shows the tube in flat-laid state where two opposite halves of the wall of the tube is close to and/or is abutting each other.

Within the scope of the invention can the flat-laid tube be folded up into more sets of folds. The volume of the flat laid tube and thereby of the case too is advantageously decreased each time the tube is folded up once more.

In the present example is the flat-laid tube folded up into two sets of folds only, namely a first set of first folds 9 and a second set of second folds 11.

The first set of first folds 9 is achieved by along two first folding lines 8 folding up the tube, seen in FIG. 3, into three first folds 9.

The number of first folds 9 can however within the scope of the invention be another one than three, e.g. be between 2 and 10, preferable between 3 and 7.

Figure 6:
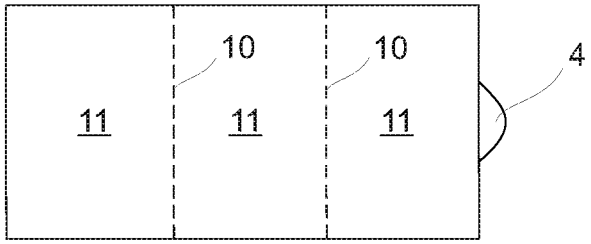
FIG. 6 shows, seen from the side, the tube shown in FIG. 3 folded up into first folds.
Figure 7:
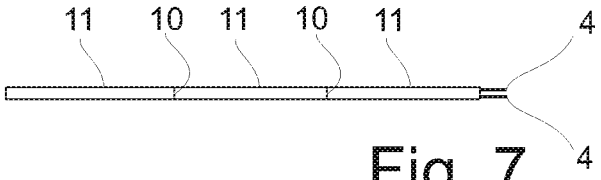
FIG. 7 shows the same, but seen from the edge side of the first folds.

The first set of first folds 9 are in FIG. 6 shown from the side and in FIG. 7 from the side of the edge. The flaps 4 are protruding from the right fold 11.

The second set of second folds 11 is achieved by along two second folding lines 10 folding up the first set of first folds 9 into three second folds 11.

The number of second folds 11 can however within the scope of the invention be another one than three, e.g. be between 2 and 20, preferable between 7 and 15.

Figure 8:
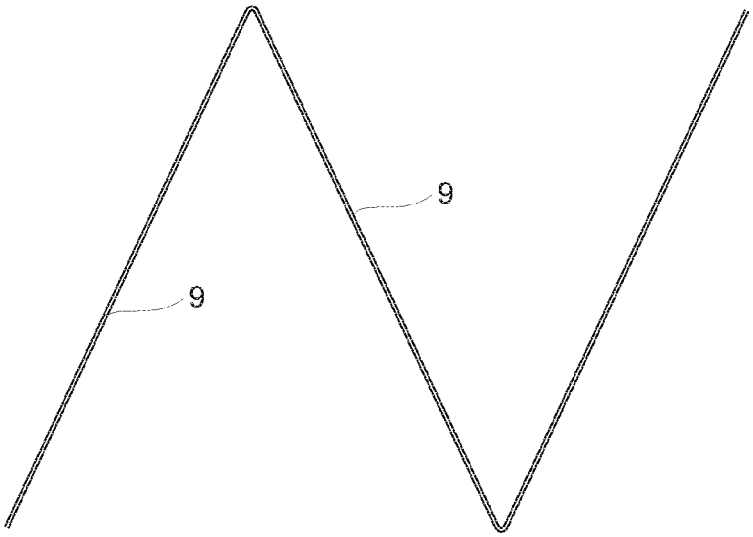
FIG. 8 shows in a larger scale a cross-sectional view of the first folds shown in FIG. 6 in an intermediate step.
Figure 9:
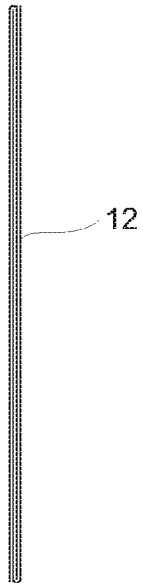
FIG. 9 shows the same, but in a finished step.

FIG. 8 shows a cross section of the first folds 9 in an intermediate step and FIG. 9 shows the first folds folded up into a compact first packet 12 of parallel first folds 9 placed close to and/or abutting each other.

Figure 10:
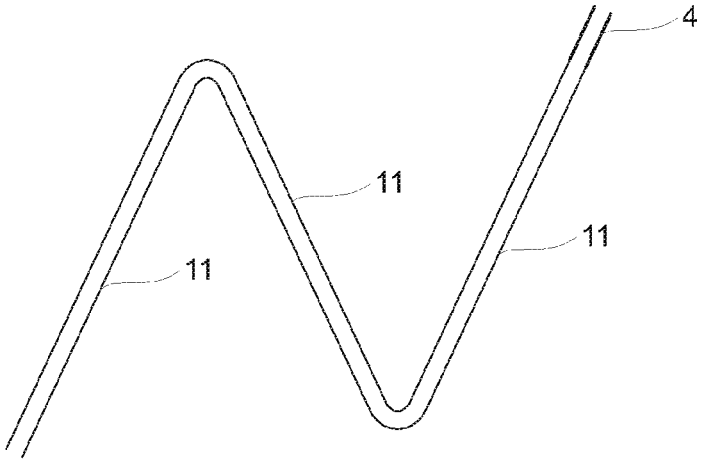
FIG. 10 shows in a lager scale a cross-sectional view of the first folds shown in FIG. 9 folded up into second folds in an intermediate step.
Figure 11:
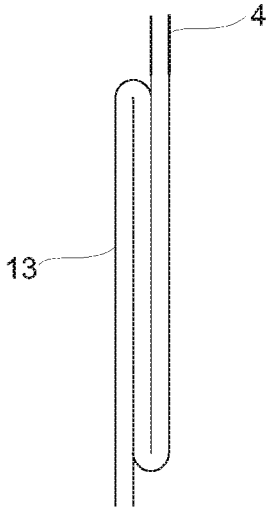
FIG. 11 shows the same, but in a finished step.

FIG. 10 shows a cross section of the second folds 11 in an intermediate step and FIG. 11 shows the second folds folded up into a compact second packet 13 of parallel second folds 11 placed close to and/or abutting each other.

Said second packet 13 is in this example also the final packet of the tube, which by being folded up in this way has been imparted so little a volume that the it can be placed in the cavity of the very little case 1.

The lower end of the left second fold 11 is attached to the case in the assembled state of the assembly and is therefore a little longer than the other second folds in dependence of how said attachment is carried out. The flaps 4 are placed at top of the right fold 11.

Figure 12:
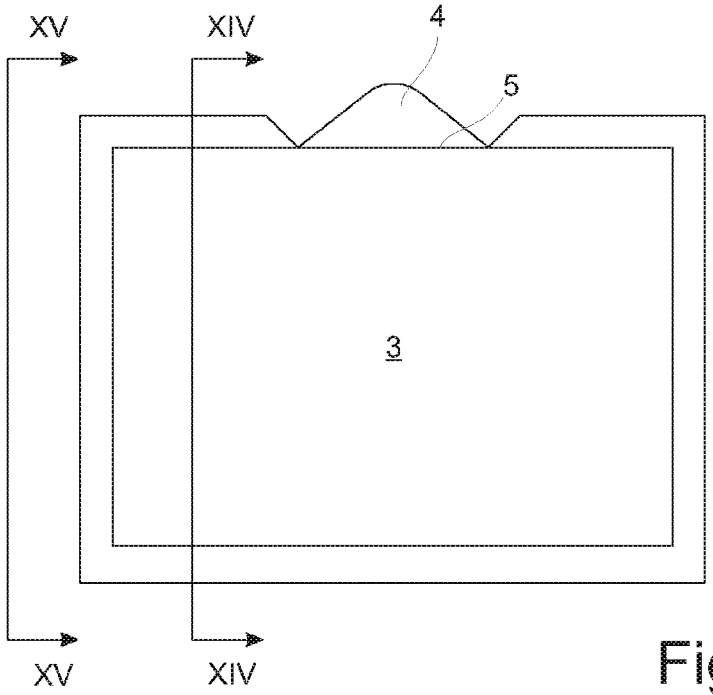
FIG. 12 shows the case, seen in FIG. 1, from the side.
Figure 13:
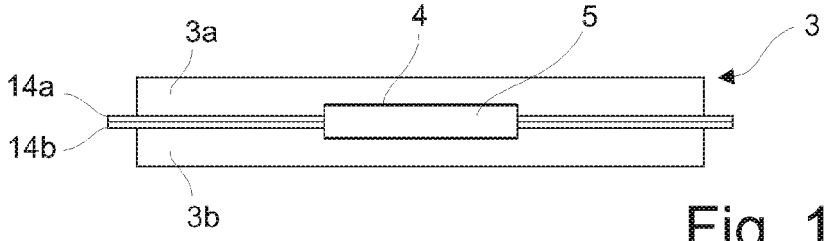
FIG. 13 shows the same, but seen from the top.

FIG. 12 shows the case 3 from the side and in FIG. 13 from the top. The flaps 4 are, as can be seen, protruding from the access opening 5 of the case 3.

As best seen in FIG. 13 consists the case 3 of two halves 3*a* and 3*b* with protruding flanges 14*a* and 14*b*. The two halves 3*a* and 3*b* of the case 3 has been interconnected by interconnecting the flanges 14*a* and 14*b* by means of e.g. pressure welding or gluing.

Figure 14:
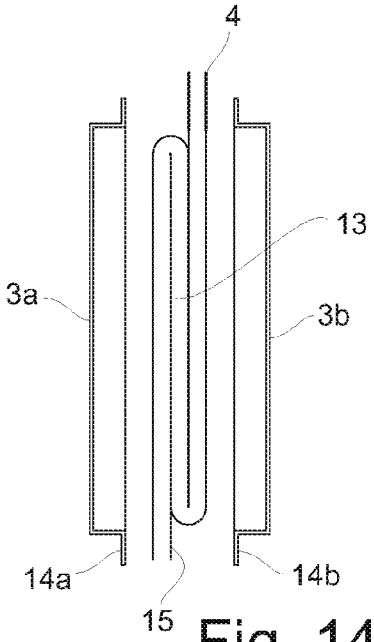
FIG. 14 is a cross section of the case taken along the line XIV-XIV in FIG. 12, but before the assembling.

FIG. 14 is a cross section of the case 3 taken along the line XIV-XIV in FIG. 12, but showing the assembling of the final packet 13 of the tube 2 and the case 3 in an initial position.

In this initial assembling step are the two halves 3*a* and 3*b* of the case 3 placed at a distance from each other and upon each their side of the final packet 13 of the tube 2.

The lower part of the final packet is formed with an extension 15, which is connected to the flanges 14*a* and 14*b* simultaneously with that the flanges themselves have been interconnected in the way mentioned above.

The tube is thereby securely anchored in the case so that the case and the tube still stick together even if the tube is pulled out of the case as much as possible.

In another embodiment of the assembly can the final packet 13 of the tube 2 be placed in the case 3 without being connected to this so that the tube can be separated from the case when the assembly is being used, (not shown).

Figure 15:
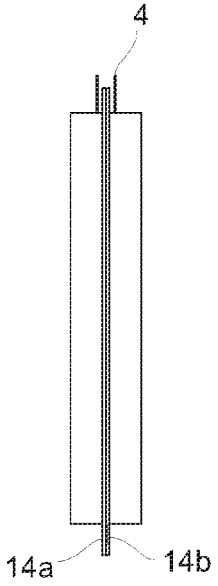
FIG. 15 shows the same in the assembled state seen into the direction XV-XV in FIG. 12.

In FIG. 15, which is seen into the direction XV-XV in FIG. 12, has the two halves 3*a* and 3*b* of the case 3 been interconnected so that they now form the finished case 3 with the final packet 13 contained inside the case except of the flaps 4, which are protruding out of the access opening 5 of the case.

Within the scope of the invention can the case however be formed in other suitable ways than mentioned above and the assembling can take place also in other ways.

Deciding is that the large tube is folded up into a compact packet that can be placed in the small case.

FIGS. 16-19 shows a variant of the case corresponding at least in the main to the case 3 shown FIGS. 12-15. Same parts therefore are denoted same numerals.

In FIGS. 12-15 is the flap 4 protruding out of the access opening 5 of the case 3 in the resting state of the assembly while the flap 4 is placed inside the case in the variant of the case 16.

Figure 16:
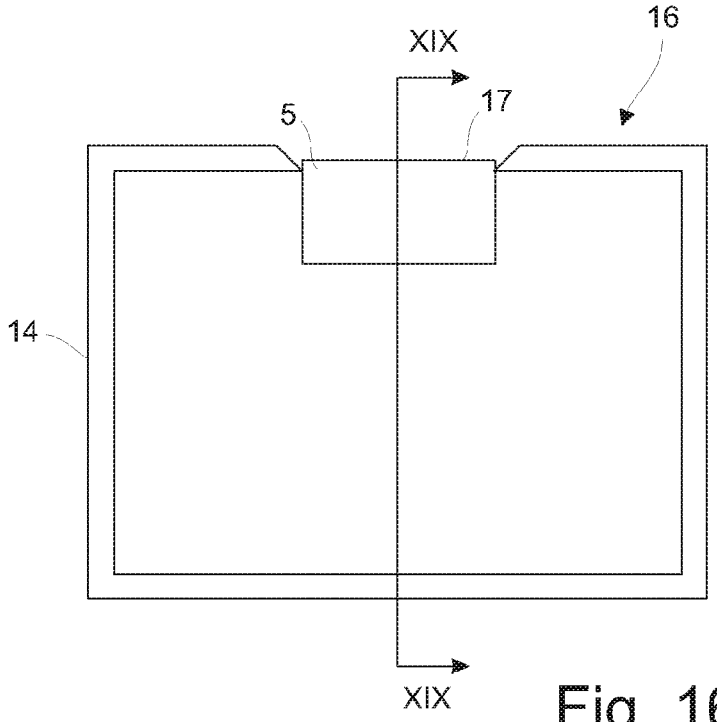
FIG. 16 shows, seen from the side, a variant of the case shown in FIG. 12.
Figure 17:
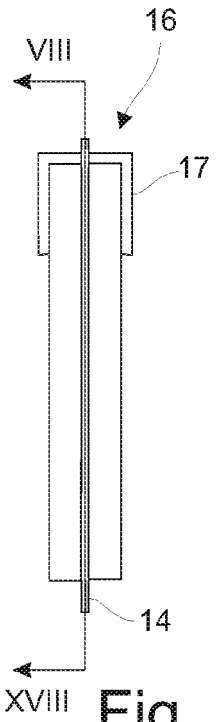
FIG. 17 is a lateral view of the case shown in FIG. 16.

FIG. 16 shows the case 16 seen from the front side and FIG. 17 from the lateral edge side. The flaps 4 cannot be seen in these figures since a detachable cap 17, which in this example is U-formed, covers the access opening 5.

The assembly is in FIG. 16 and FIG. 17 seen in its resting state where the flaps 4 are present inside the case only so that the flaps securely are protected against external influences.

Figure 18:
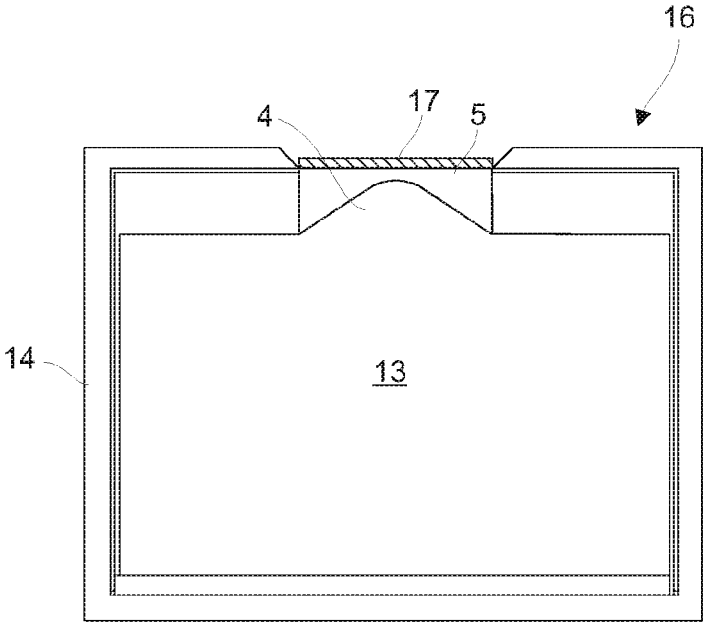
FIG. 18 is a cross section of the case taken along the line XVIII-XVIII in FIG. 17.
Figure 19:
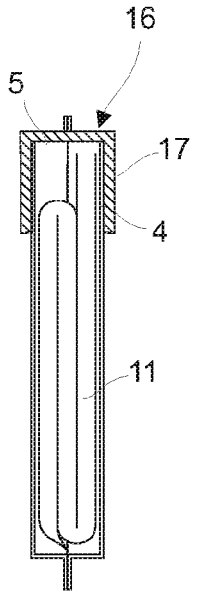
FIG. 19 is a cross section of the case taken along the line XIX-XIX in FIG. 16.

FIG. 18 is a cross section of the case 16 taken along the line XVIII-XVIII in FIG. 17 and FIG. 19 is a cross section of the case 16 taken along the line XIX-XIX in FIG. 16.

These figures show the final packet 13 of the folds 11 of the tube 2 with the flaps 4 placed inside the case 16. The flaps are in this example integral with the tube 2.

The cap 17 is removed when the assembly is going to be used as a bag whereby the access opening 5 in the case 16 is exposed so that the user (not seen) can get hold in the flaps 4 with the fingers (not seen) and pull out the tube 2 from the case 16.

In another embodiment (not shown) of this variant of the case is the cap formed as a part of the wall of the case. A perforated line (not seen) between this part of the wall of the case and the rest of the wall of the case is allowing the user (not shown) to separate the cap from the case 16 for getting access to the flaps and thereby be able to pull out the tube of the case.

In a preferred embodiment of the invention the case can be made of a flexible plastic with a wall-thickness of between 30 and 60 μm and the tube be made of a plastic foil with a thickness of between 10 and 50 μm.

The length of tube can moreover be between 150 mm and 800 mm, preferable between 300 mm and 500 mm and the width of the flat-laid tube be between 50 mm and 750 mm, preferable between 150 mm and 400 mm.

The width of the case can furthermore be between 20 mm and 90 mm, preferable between 30 mm and 80 mm and the depth of the case can be between 15 mm and 75 mm, preferable between 30 and 60 mm.

EXAMPLE

In an assembly consisting of a bag and a case for accommodating the folded bag was the bag made of polyester with a wall-thickness of 20 μm, a length of 450 mm and a width of 350 mm in flat-laid state, and the case was made of polyester with a wall-thickness of 50 μm and had a mainly rectangular shape with a depth of 50 mm, a width of 80 mm and a thickness of 4 mm.

What is claimed is:

1. An assembly comprising a single recipient and a retainer, wherein the single recipient is configured for receiving objects of different kinds in a using state of the assembly, the retainer having a retainer access opening, and in a resting state of the assembly, the retainer serves for retaining the recipient, wherein the recipient, before being assembled with the retainer, is arranged as a flat-laid, zig-zag folded flexible tube, the tube has a first end part and second end part, and the tube in the resting state of the assembly has at least nearly parallel zig-zag folds which are placed close to and/or are abutting each other, wherein the retainer defines a cavity having an area defined by a depth extending into a direction perpendicular to the retainer access opening and a width extending in a direction perpendicular to the direction of the depth, wherein one of the folds is attached to the retainer by welding or gluing while the other folds are freely arranged in the retainer, whereby the tube before folding into the flat-laid, zig-zag folded configuration has a larger area than said cavity, and wherein the second end part of the tube is equipped with or is integral with at least one flap, which is protruding outwards of the access opening of the retainer when the tube is folded up in the retainer.

2. An assembly according to claim 1 wherein the second end part of the tube is formed with a mouth which is placed at the access opening of the retainer when the tube is folded up in the retainer.

3. An assembly according to claim 1, wherein the access opening of the retainer has a length, which is smaller than the width of the retainer.

4. An assembly according to claim 1, wherein the second end part of the tube is equipped with or is integral with at least one flap, which is present in the retainer in the resting state of the assembly when the tube is folded up in the retainer while the access opening of the retainer is covered by a cap.

5. An assembly according to claim 1, wherein the tube is folded, when being in the flat-laid state, along a first row of first folding lines, which are extending crosswise the end parts of the tube and are defining a first row of parallel first folds of which at least one has a width with about the same size as the width of the cavity of the retainer, and that the first row of first the folds is folded along a second row of second folding lines, which are extending crosswise the first folding lines and are defining the second row of parallel the second folds of which at least one has a width with about the same size as the depth of the cavity in the retainer.

6. An assembly according to claim 5, wherein a first end fold at each of the ends of the first row of the first folds is folded along a first folding line only.

7. An assembly according to claim 6, wherein at least one of the first end folds has another size and shape than the other first folds.

8. An assembly according to claim 5, wherein a second end fold at each of the ends of the second row of the second folds is folded along a second folding line only.

9. An assembly according to claim 8, wherein at least one of the second end folds has another size and shape than the other second folds.

10. An assembly according to claim 8, wherein a first one of the second end folds is attached to the retainer while the other second folds freely are arranged in the retainer.

11. An assembly according to claim 1, wherein:

the length of tube is between 150 mm and 800 mm or is between 300 mm and 500 mm, and that the width of the flat-laid tube is between 50 mm and 750 mm or is between 150 mm and 400-mm, and/or the width of the case retainer is between 20 mm and 90 mm or is between 30 mm and 80 mm, and that the depth of the case retainer is between 15 mm and 75 mm or is between 30 and 60 mm.

12. An assembly according to claim 1, wherein:

the number of first folds is between 2 and 10 or is between 3 and 6, and/or the number of second folds is between 2 and 20 or is between 7 and 15.

13. An assembly according to claim 1, wherein both of the end parts of the tube are open, while all the sides of the retainer are closed except at the access opening.

14. An assembly according to claim 1, wherein the first end part of the tube is closed, while the second end part is open.

15. An assembly according to claim 1, wherein the tube is made of a foil of plastic, fabric or paper.

16. An assembly according to claim 1, wherein the retainer is made of plastic, paper, cardboard or metal.

17. A method for producing a disposable assembly according to claim 1, which method comprises:

providing the retainer with the access opening into the cavity;

providing the recipient as the flat-laid, zig-zag folded flexible tube, formed by flat-laying the tube, folding up the flat-laid tube into the nearly parallel zig-zag folds, and placing the folded tube in the retainer to form the assembly, wherein one of the folds is attached to the retainer by welding or gluing while the other folds freely are arranged therein.

18. A method according to claim 17, wherein the flat-laid tube is folded along a first row of first folding lines, which are extending crosswise the end parts of the tube and are defining a first row of parallel first folds of which at least one has a width with about the same size as the width of the cavity of the retainer, folding the first row of the first folds along a second row of second folding lines, which are extending crosswise the first folding lines and are defining the second row of parallel the second folds, and forming at least one of the second folds with a width with about the same size as the depth of the cavity in the retainer.

19. A disposable assembly comprising a single recipient and a retainer, wherein the single recipient is configured for receiving objects of different kinds in a using state of the assembly, and the retainer includes therein only the single recipient, with the retainer having a retainer access opening, and in a resting state of the assembly the retainer serves for retaining the recipient, wherein the recipient, before being assembled with the retainer, is arranged as a flat-laid, zig-zag folded flexible tube made of a foil of plastic, fabric or paper, the tube has a first end part and second end part, and the tube in the resting state of the assembly has at least nearly parallel zig-zag folds which are placed close to and/or are abutting each other, wherein the retainer defines a cavity having an area defined by a depth extending into a direction perpendicular to the retainer access opening and a width extending in a direction perpendicular to the direction of the depth, wherein one of the folds is attached to the retainer by welding or gluing while the other folds are freely arranged in the retainer, whereby the tube before folding into the flat-laid, zig-zag folded configuration has a larger area than said cavity and after use thereof the retainer and attached recipient together are disposed, and wherein the second end part of the tube is equipped with or is integral with at least one flap, which is protruding outwards of the access opening of the retainer when the tube is folded up in the retainer.

* * * * *